US007677922B2

(12) United States Patent
Chuang

(10) Patent No.: US 7,677,922 B2
(45) Date of Patent: Mar. 16, 2010

(54) COMPOSITE CONNECTOR

(76) Inventor: Yi-Fang Chuang, 5F., No.15, Lane 117, Sec. 4, Sanhe Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 12/400,316

(22) Filed: Mar. 9, 2009

(65) Prior Publication Data

US 2009/0298346 A1 Dec. 3, 2009

(30) Foreign Application Priority Data

Jun. 3, 2008 (TW) ..... 97209751 U

(51) Int. Cl.
*H01R 13/60* (2006.01)

(52) U.S. Cl. ..... 439/541.5

(58) Field of Classification Search ..... 439/540.1, 439/541.5, 607

See application file for complete search history.

(56) References Cited

U.S. PATENT DOCUMENTS

| | | | | |
|---|---|---|---|---|
| 7,410,391 | B2 * | 8/2008 | Wan et al. | 439/607.01 |
| 7,442,056 | B1 * | 10/2008 | Ju | 439/79 |
| 2004/0180574 | A1 * | 9/2004 | Liu | 439/541.5 |
| 2007/0105435 | A1 * | 5/2007 | Chen et al. | 439/540.1 |
| 2007/0232132 | A1 * | 10/2007 | Ling et al. | 439/541.5 |
| 2008/0215788 | A1 * | 9/2008 | Kedem | 710/300 |

* cited by examiner

*Primary Examiner*—Briggitte R Hammond
(74) *Attorney, Agent, or Firm*—Chun-Ming Shih

(57) ABSTRACT

A composite connector includes an insulating base, an S/PDIF connector and a Display port connector. The insulating base is formed with a first accommodating trough and a second accommodating trough adjacent to the first accommodating trough. The S/PDIF connector is partially accommodated in the first accommodating trough. The Display port connector is accommodated in the second accommodating trough. The first accommodating trough and the second accommodating trough are arranged vertically. The present composite connector has an effect of saving space.

12 Claims, 9 Drawing Sheets

COMPOSITE CONNECTOR

BACKGROUND OF THE INVENTION

1. Field of the Invention

The present invention relates to a composite connector, and in particular to a composite connector used in an electronic device.

2. Description of Prior Art

Recently, when a computer host and an electronic device are to be connected electrically, in addition to a Universal Serial Bus (referred to as "USB" hereinafter) connector, the manufacturers in this field continuously propose alternative connectors that have better transmission performance or are capable of transmitting audio/video signals directly with reduced volume, thereby facilitating its usage, such as High Definition Multimedia (referred to as "HDMI" hereinafter) connector, Displayport connector, Micro-USB connector, S/PDIF connector and the like.

However, in practice, the above-mentioned connectors have a common problem that each kind of connectors occupies too much space on the back surface of the computer host. Each connecting port on the back surface of the computer host is secured to a main board. Conductive terminals within a connecting port are electrically connected to the main board. Unfortunately, the space above the connecting port secured to the main board is not used efficiently.

Various kinds of connectors are developed recently. The back surface of the computer host has to be provided with each kind of connectors for a corresponding electronic device. Therefore, it is an important issue to use the space on the back surface of the computer host and arrange various kinds of connectors in a limited space.

SUMMARY OF THE INVENTION

The present invention is to provide a composite connector, in which an S/PDIF connector and a Displayport connector are arranged in a vertical direction, thereby integrating the two connectors in an insulating base so as to save space.

The present invention is to provide a composite connector. With the S/PDIF connector and the Displayport connector are integrated in an insulating base, the cost of molds is reduced, and thus the production cost can be saved.

The present invention is to provide a composite connector, which includes an insulating base, an S/PDIF connector and a Displayport connector. The insulating base is formed with a first accommodating trough and a second accommodating trough adjacent to the first accommodating trough. The S/PDIF connector is partially accommodating in the first accommodating trough. The Displayport connector is partially accommodated in the second accommodating trough.

DETAILED DESCRIPTION OF THE INVENTION

The characteristics and technical contents of the present invention will be explained with reference to the accompanying drawings. However, the drawings are illustrative only but not used to limit the present invention.

Figure 1:
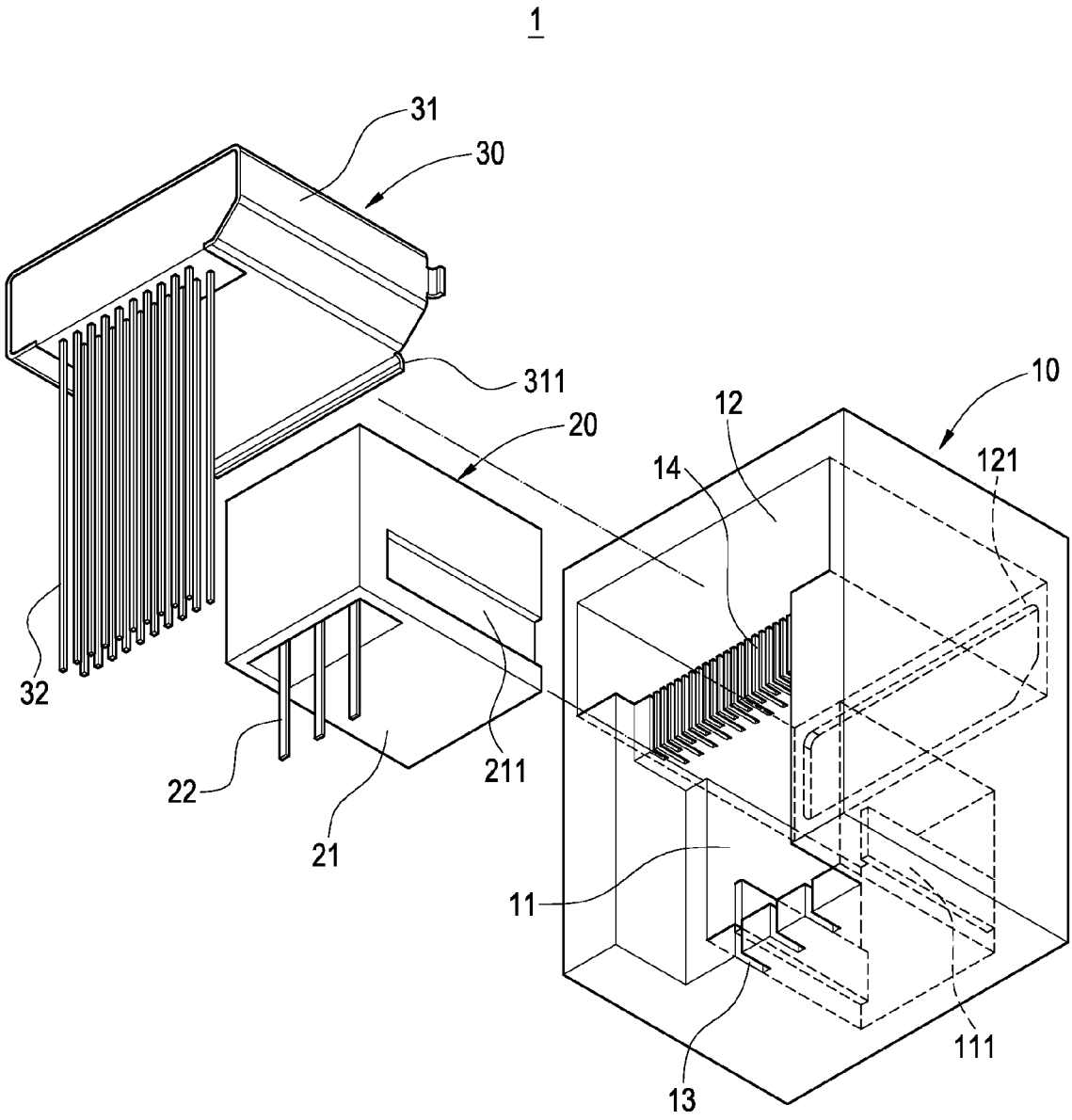
FIG. 1 is an exploded perspective of the present invention.
Figure 2:
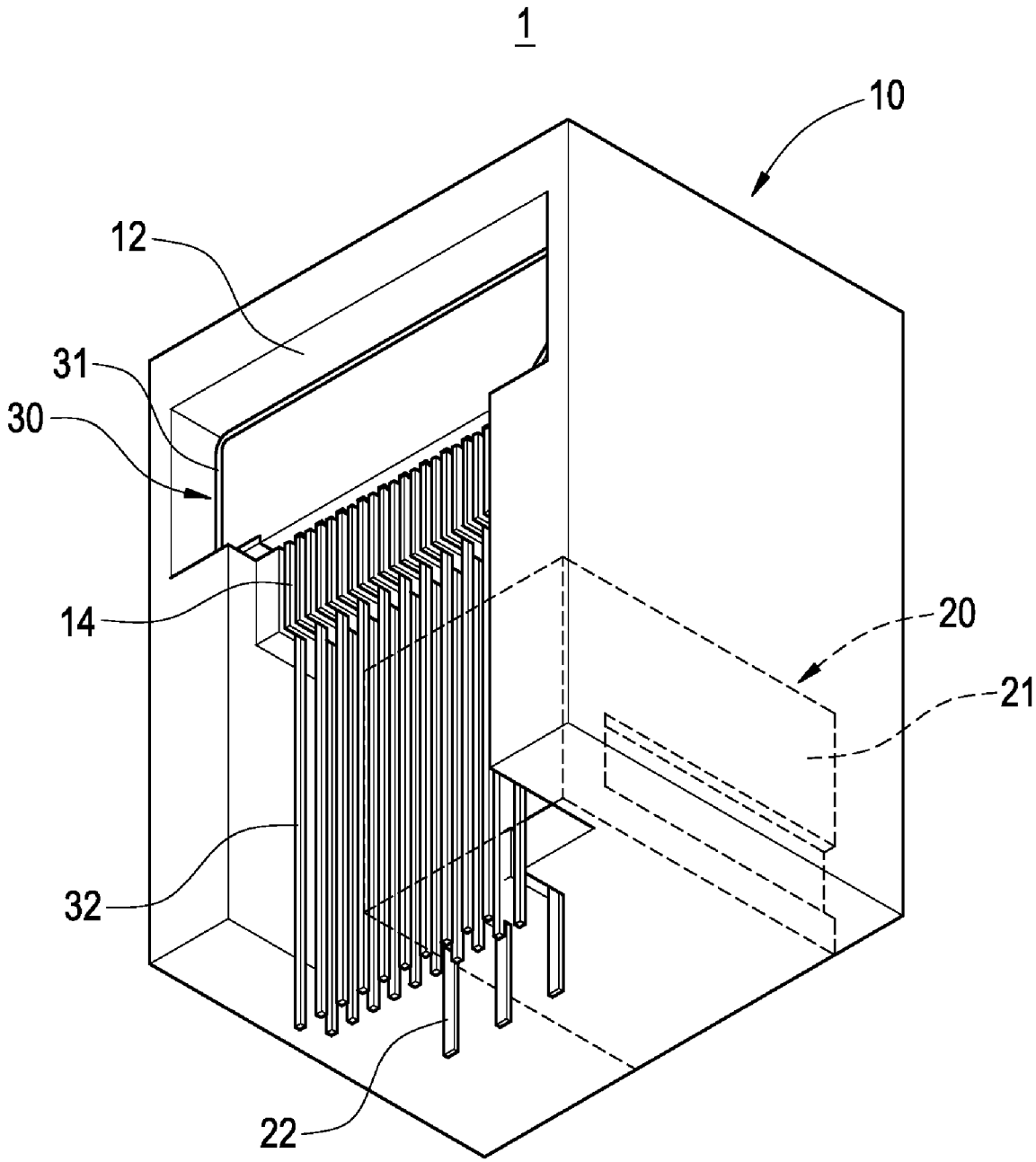
FIG. 2 is an assembled view of the present invention.
Figure 3:
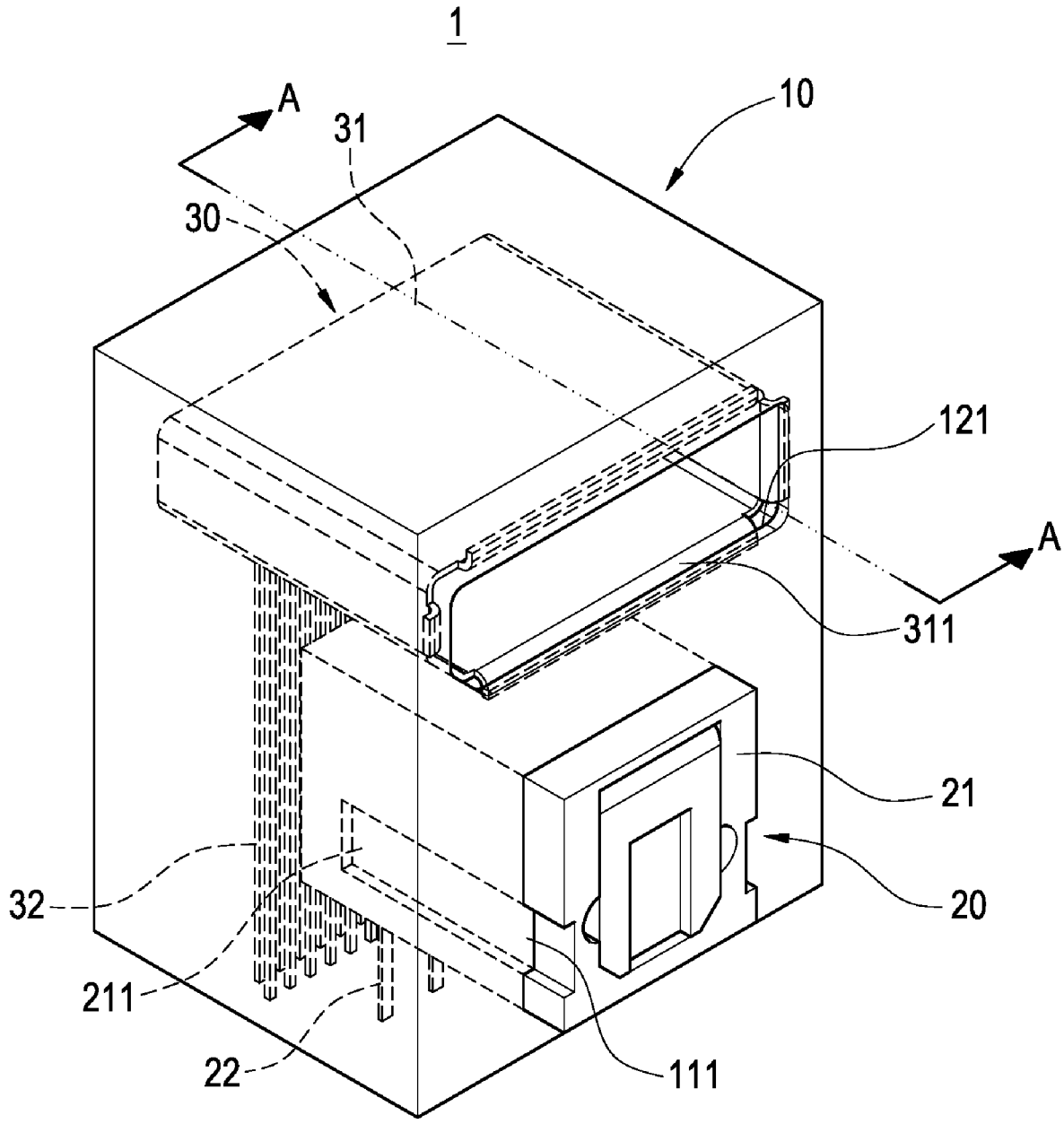
FIG. 3 is an assembled perspective view of the present invention.

Please refer to FIGS. 1 to 3. FIG. 1 is an exploded perspective of the present invention. FIG. 2 is an assembled view of the present invention. FIG. 3 is an assembled perspective view of the present invention. The present invention provides a composite connector, which includes an insulating base 10, an S/PDIF connector 20 and a Displayport connector 30.

The insulating base 10 is a rectangular solid. One surface of the insulating base 10 is formed with a first accommodating trough 11 penetrating the insulating base 10. The inner wall of each side of the first accommodating trough 11 is formed with a protruding block 111 respectively. The protruding block 111 is shaped as a post. The insulating base 10 is further formed with a plurality of first passages 13 in communication with the first accommodating trough 11.

Further, the insulating base 10 is further formed with a second accommodating trough 12. The second accommodating trough 12 is located below the first accommodating trough 11. The inner wall of one end of the second accommodating trough 12 extends inwards to form a retaining wall 121. The insulating base 10 is formed with a plurality of second passages 14 in communication with the second accommodating trough 12. Further, the first accommodating trough 11 and the second accommodating trough 12 are arranged in a vertical direction. That is, the first accommodating trough 11 is located above the second accommodating trough 12, or the first accommodating trough 11 is located below the second accommodating trough 12.

The S/PDIF connector 20 includes a body 21 and a plurality of first conductive terminals 22 connected to the body 21. Both sides of the body 21 are formed with a slot 211 respectively to correspond to the protruding block 111. The first conductive terminals 22 are connected vertically to one end of the body 21 and are exposed to the underside of the body 21. Further, the first conductive terminals 22 correspond to the first passages 13. When the S/PDIF connector 20 is disposed in the first accommodating trough 11, the protruding block 111 is inserted into the slot 211, and the first conductive terminals 22 are accommodated in the first passages 13.

"S/PDIF" is the abbreviation of Sony/Philips Digital Interface, which means a digital audio output connector jointly proposed by Sony Co. and Philips Co. and can be widely used for CD, sound cards and home electronic appliances. The primary function of the S/PDIF is to improve the quality of sound outputted by the CD, increase the signal/noise ratio and provide a purer sound effect. There are two kinds of connecting ports used for the S/PDIF connector, one is RCA coaxial connecting port and the other is TOSLINK optical cable connecting port. In the present invention, the TOSLINK optical cable connecting port is selected to be used in the S/PDIF connector 20, but it not limited thereto.

The Display port connector 30 includes a housing 31 and a plurality of second conductive terminals 32 connected to the housing 31. One end of the housing 31 extends outwards to form a plurality of folds 311. The second conductive terminals are connected vertically to one end of the body 31 and are exposed to the underside the housing 31. The second conductive terminals 32 correspond to the second passages 14. The folds 311 correspond to the retaining wall 121. When the housing 31 is disposed in the second accommodating trough 12, the folds 311 abut the retaining wall 121 to fix the Displayport connector 30 into the insulating base 10. The second conductive terminals 32 are accommodated in the second passages 14.

The Display port connector is one utilizing a digital transmission interface. The Displayport connector can provide a data transmission bandwidth up to 10.8 Gbps and transmit audio/video signals simultaneously, thereby providing the best quality of audio/video signal transmission. In the present invention, the Displayport connector 30 is employed.

Figure 4:
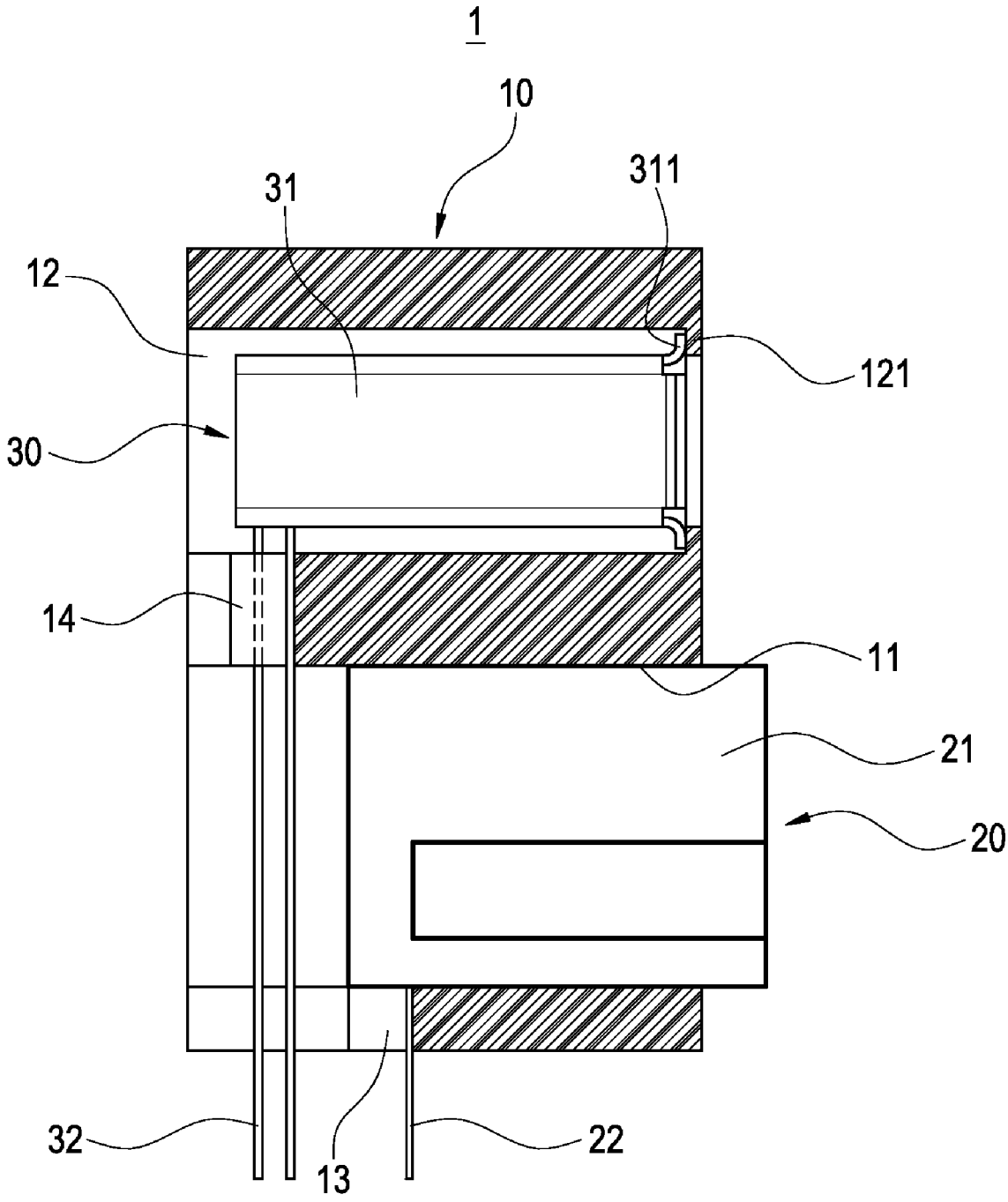
FIG. 4 is a cross-sectional view taken along the line A-A in FIG. 3.
Figure 5:
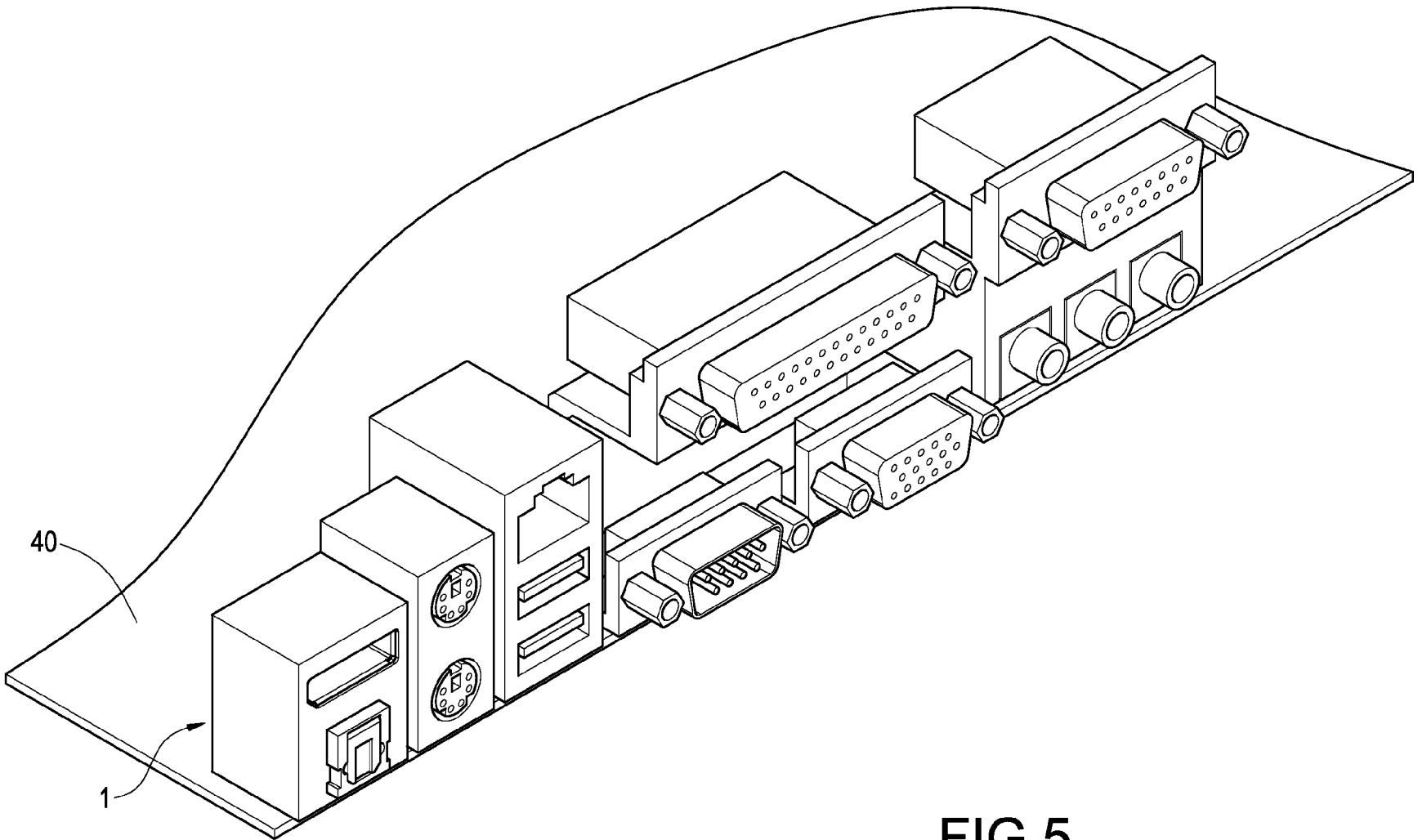
FIG. 5 is a perspective view showing the first embodiment of the present invention.

Please refer to FIGS. 4 and 5. FIG. 4 is a cross-sectional view taken along the line A-A of FIG. 3, and FIG. 5 is a perspective view of the first embodiment of the present invention. The S/PDIF connector 20 and the Displayport connector 30 are arranged vertically on the insulating base 10. Then, the insulating base 10 is arranged on one side of a main board 40. In this way, the horizontal space on one side of the main board 40 for arranging various connectors can be saved. Thus, more connectors can be connected on one side of the main board 40.

Figure 6:
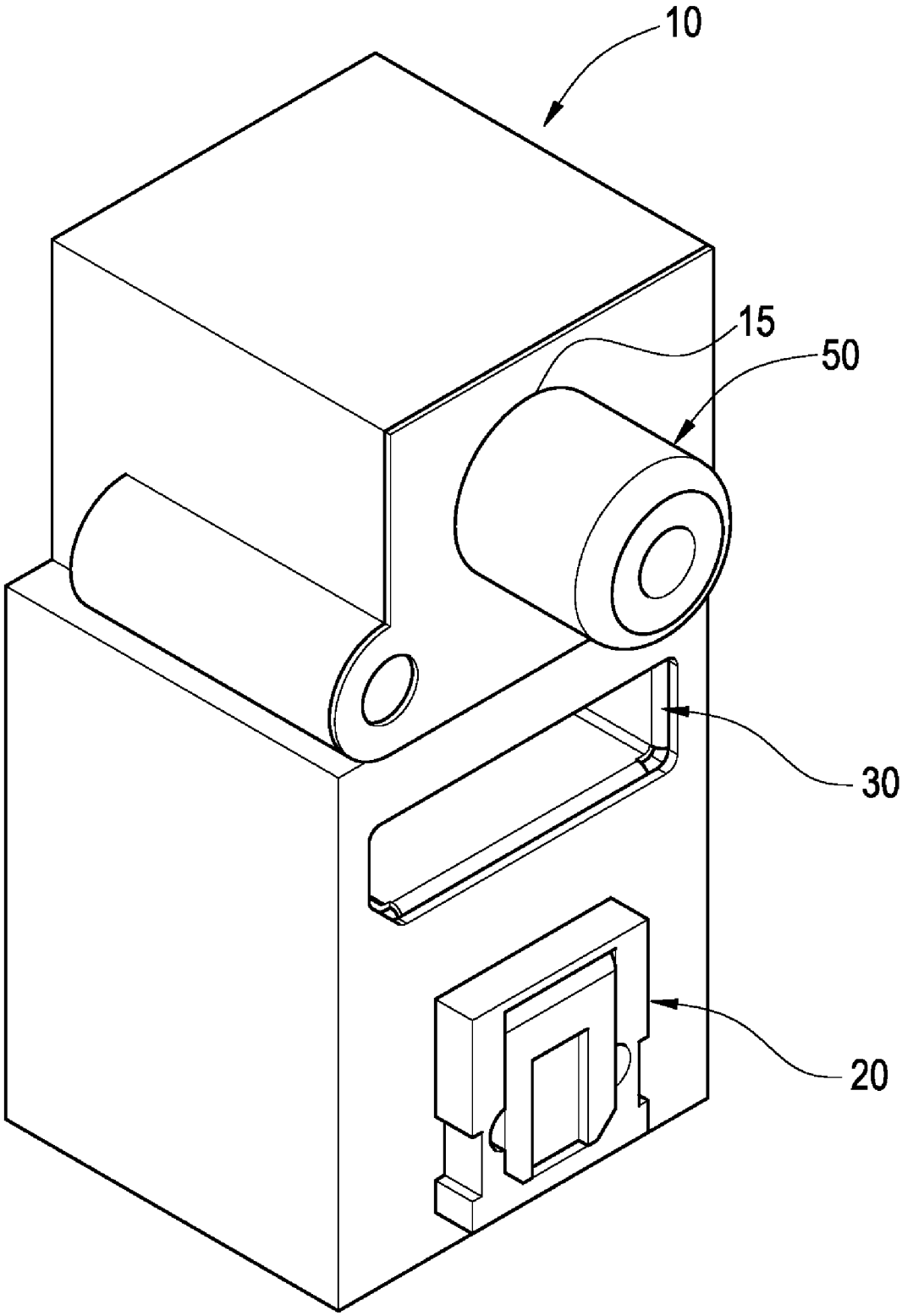
FIG. 6 is a perspective view showing the second embodiment of the present invention.

Please refer to FIG. 6, which is a perspective view showing the second embodiment of the present invention. The insulating base 10 is further provided with a third accommodating trough 15. The present composite connector also includes an S/PDIF coaxial connector 50 accommodated in the third accommodating trough 15. The connecting port of the S/PDIF coaxial connector is a RCA coaxial connecting port. The S/PDIF coaxial connector 50 is formed above the Displayport connector 30.

Figure 7:
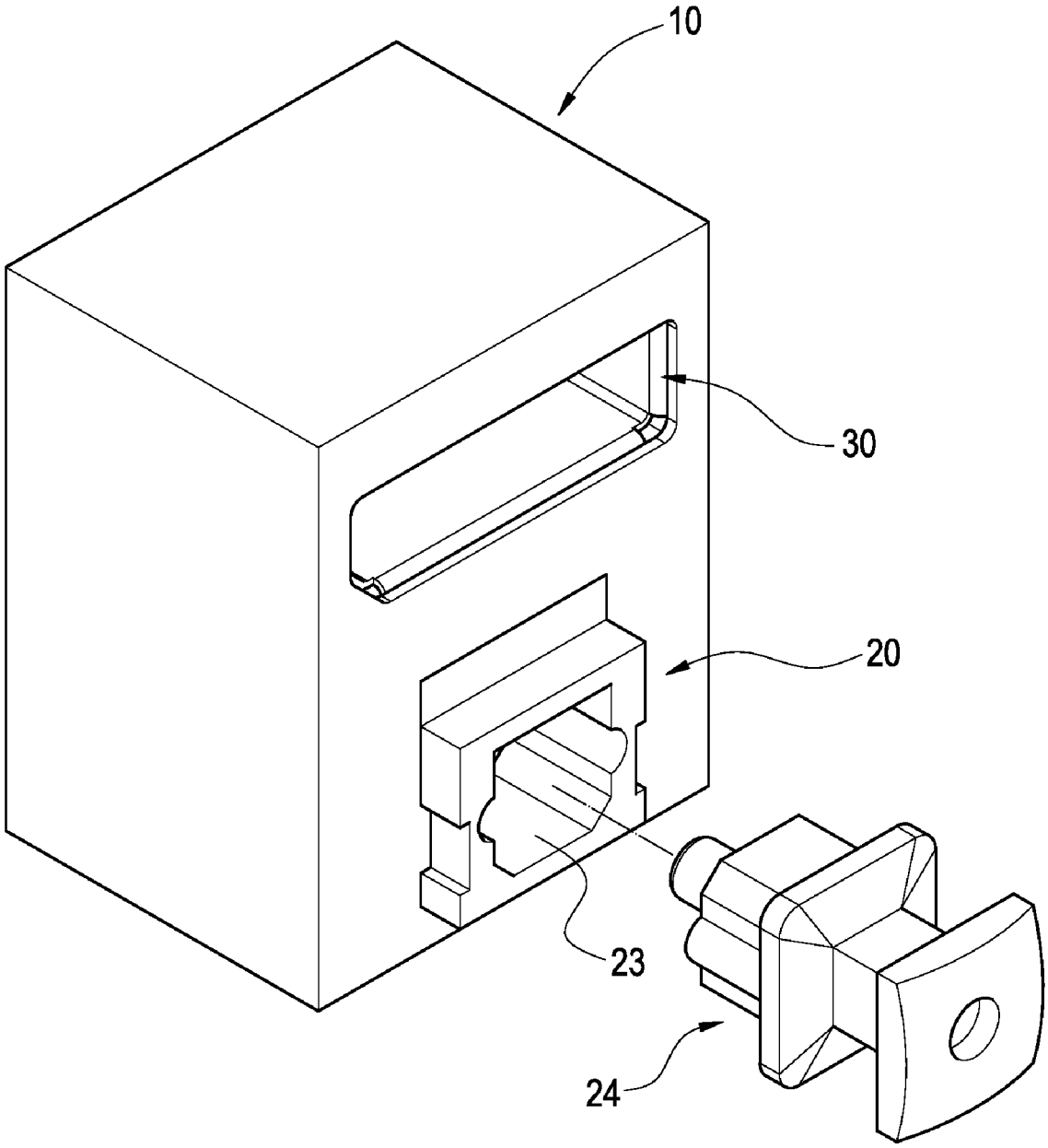
FIG. 7 is a perspective view showing the third embodiment of the present invention.

Please refer to FIG. 7, which is a perspective view showing the third embodiment of the present invention. In the present embodiment, the S/PDIF connector 20 is TOSLINK optical cable connector. The S/PDIF connector 20 is further provided with an insertion slot 23 for allowing a cover 24 to be inserted therein. Before the S/PDIF connector 20 is connected to a transmission line, the cover 24 can prevent dust from entering the S/PDIF connector 20.

Figure 8:
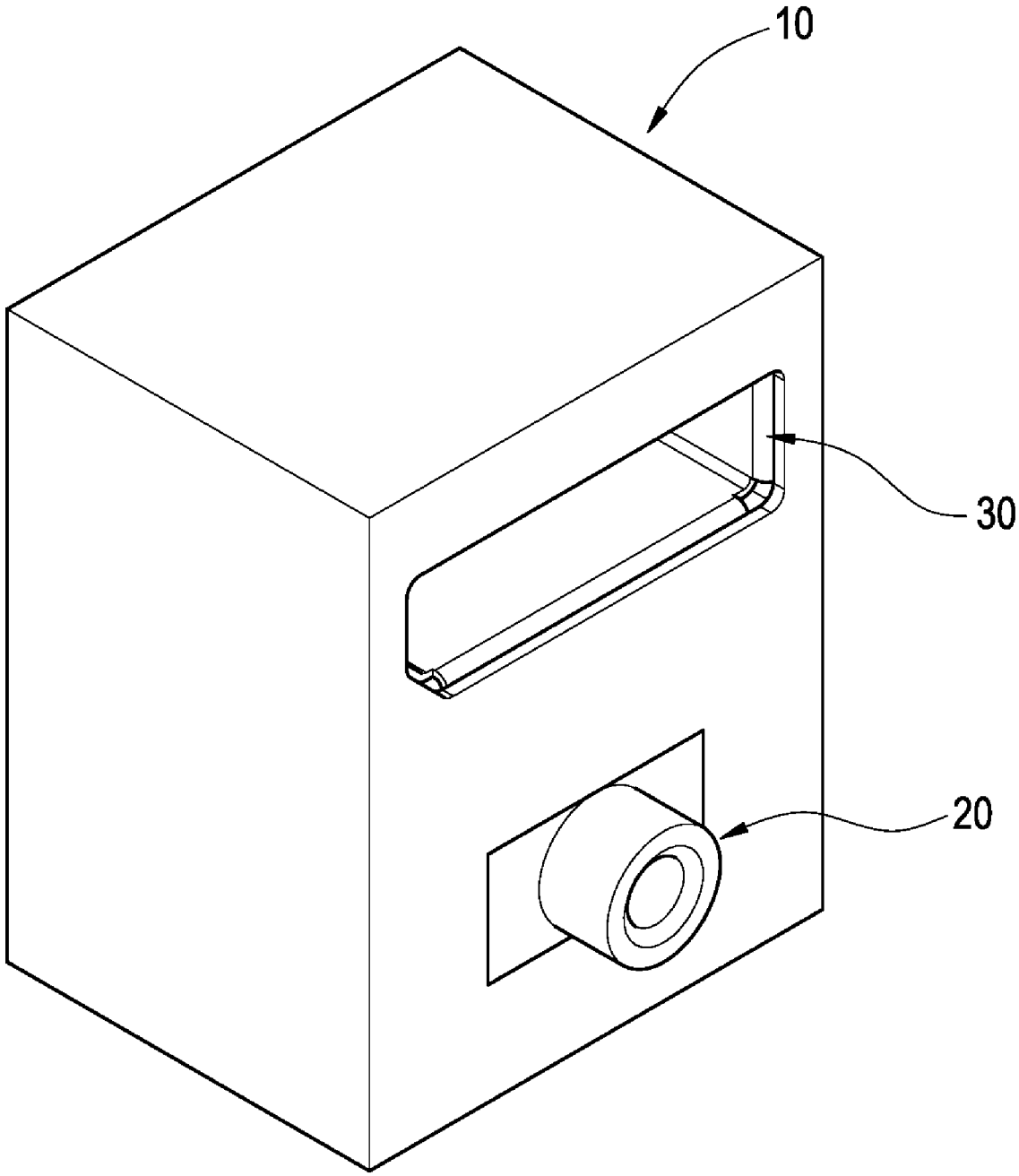
FIG. 8 is a perspective view showing the fourth embodiment of the present invention.

Please refer to FIG. 8, which is a perspective view showing the fourth embodiment of the present invention. In the present embodiment, the S/DIF connector 20 can be a TOSLINK optical cable connector having a Mini-Jack connecting port for allowing a jack-type transmission line to be connected thereto.

Figure 9:
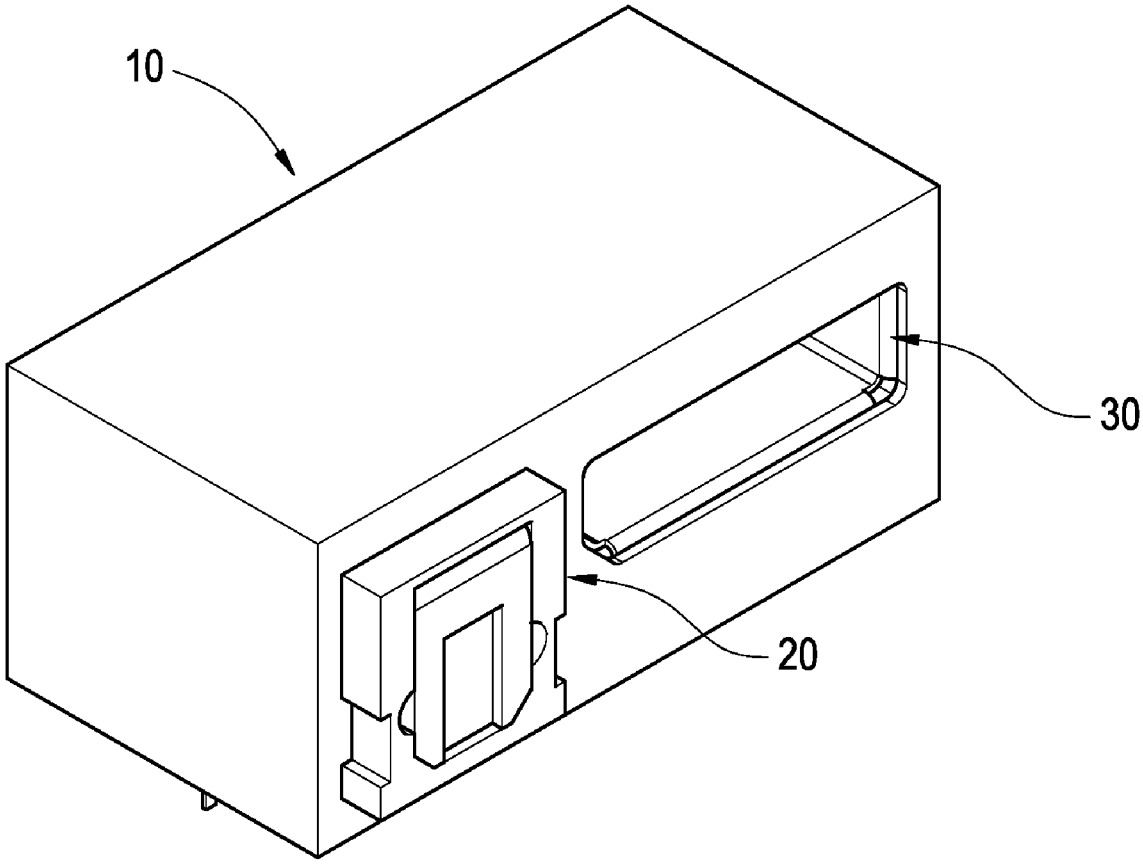
FIG. 9 is a perspective view showing the fifth embodiment of the present invention.

Please refer to FIG. 9, which is a perspective view showing the fifth embodiment of the present invention. The two different kinds of connectors mentioned in the present invention can be arranged vertically or horizontally together. The horizontal arrangement of two connectors is more suitable for a thinner notebook.

Thus, the composite connector of the present invention has advantageous features as follows:

(I) Since the S/PDIF connector 20 and the Displayport connector 30 are arranged vertically to be integrated in an insulating base 10, the space on one side of the main board 40 can be saved. The saved space can be utilized for other electronic components. If possible, three kinds of connectors may be integrated in an insulating base 10 to save more space.

Since the S/PDIF connector 20 and the Displayport connector 30 are arranged vertically to be integrated in an insulating base 10, only one mold is enough to manufacture the insulating base 10, thereby reducing the cost of molds. In assembling, only one insulating base 10 needs to be assembled, so that the assembling speed can be increased and the whole manufacture cost can be saved.

According to the above, the composite connector of the present invention already demonstrates industrial applicability, novelty and inventive steps. Further, the structure of the present invention has not been seen in products of the same kind or let in public use. Thus, the present invention really conforms to the requirements for a utility model patent.

What is claimed is:

1. A composite connector, comprising:

an insulating base formed with a first accommodating trough and a second accommodating trough adjacent to the first accommodating trough;

an S/PDIF connector partially accommodated in the first accommodating trough; and a Displayport connector partially accommodated in the second accommodating trough, wherein the S/PDIF connector comprises a body and a plurality of first conductive terminals vertically connected to one end of the body and exposed to the underside of the body, the body is accommodated in the first accommodating trough, the insulating base is provided with a plurality of passages in communication with the first accommodating trough, and the first conductive terminals are accommodated in the first passages.

2. The composite connector according to claim 1, wherein the first accommodating trough and the second accommodating trough are arranged vertically.

3. The composite connector according to claim 1, wherein both sides of the body are formed with a trough respectively, a protruding block protrudes from the inner wall of each side of the first accommodating trough, and the protruding block is inserted into the trough.

4. The composite connector according to claim 1, wherein the Displayport connector includes a housing and a plurality of second conductive terminals vertically connected to one end of the housing and exposed to the underside of the housing, the housing is accommodated in the second accommodating trough, the insulating base is provided with a plurality of second passages in communication with the second accommodating trough, and the second conductive terminals are accommodated in the second passages.

5. The composite connector according to claim 4, wherein one end of the housing extends outwards to form a plurality of folds, the inner wall of one end of the second accommodating trough extends inwards to form a retaining wall, and the folds abut the retaining wall.

6. The composite connector according to claim 1, wherein the insulating base is a rectangular solid.

7. A composite connector, comprising:

an insulating base formed with a first accommodating trough and a second accommodating trough adjacent to the first accommodating trough;

an S/PDIF connector partially accommodated in the first accommodating trough; and a Displayport connector partially accommodated in the second accommodating trough, wherein the Displayport connector includes a housing and a plurality of second conductive terminals vertically connected to one end of the housing and exposed to the underside of the housing, the housing is accommodated in the second accommodating trough, the insulating base is provided with a plurality of second passages in communication with the second accommodating trough, and the second conductive terminals are accommodated in the second passages.

8. The composite connector according to claim 7, wherein the first accommodating trough and the second accommodating trough are arranged vertically.

9. The composite connector according to claim 7, wherein the S/PDIF connector comprises a body and a plurality of first conductive terminals vertically connected to one end of the body and exposed to the underside of the body, the body is accommodated in the first accommodating trough, the insulating base is provided with a plurality of passages in communication with the first accommodating trough, and the first conductive terminals are accommodated in the first passages.

10. The composite connector according to claim 9, wherein both sides of the body are formed with a trough respectively, a protruding block protrudes from the inner wall of each side of the first accommodating trough, and the protruding block is inserted into the trough.

11. The composite connector according to claim 7, wherein one end of the housing extends outwards to form a plurality of folds, the inner wall of one end of the second accommodating trough extends inwards to form a retaining wall, and the folds abut the retaining wall.

12. The composite connector according to claim 7, wherein the insulating base is a rectangular solid.

* * * * *